United States Patent [19]

Johnson et al.

[11] 4,306,758

[45] Dec. 22, 1981

[54] LAMP HOLDER WITH SELF-LOCKING DEVICE

[75] Inventors: George E. Johnson, Bronxville; Walter Newman, Forest Hills, both of N.Y.

[73] Assignee: Leviton Manufacturing Company, Inc., Little Neck, N.Y.

[21] Appl. No.: 15,570

[22] Filed: Feb. 26, 1979

[51] Int. Cl.[3] ..... H01R 17/22
[52] U.S. Cl. ..... 339/54
[58] Field of Search ..... 339/54, 75 T

[56] References Cited

U.S. PATENT DOCUMENTS 2,303,156 11/1942 Bryant et al. ..... 339/54
2,424,874 7/1947 Beals ..... 339/54

*Primary Examiner*—Joseph H. McGlynn
*Attorney, Agent, or Firm*—Paul J. Sutton

[57] ABSTRACT

A lamp holder of the type used to removably hold a fluorescent lamp in a lighting fixture has a housing in which there are defined channels for inserting pins protruding from the end of the lamp and a tiltable locking member rotatable between an open position permitting the pins to enter the channels and a closed position preventing withdrawal of the pins from the channels. The locking member is held in the closed position by cooperating means on the housing and locking member.

11 Claims, 12 Drawing Figures

FIG. 3
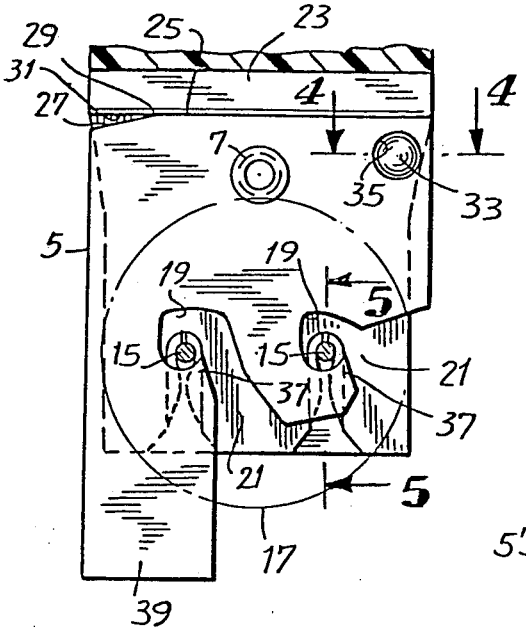
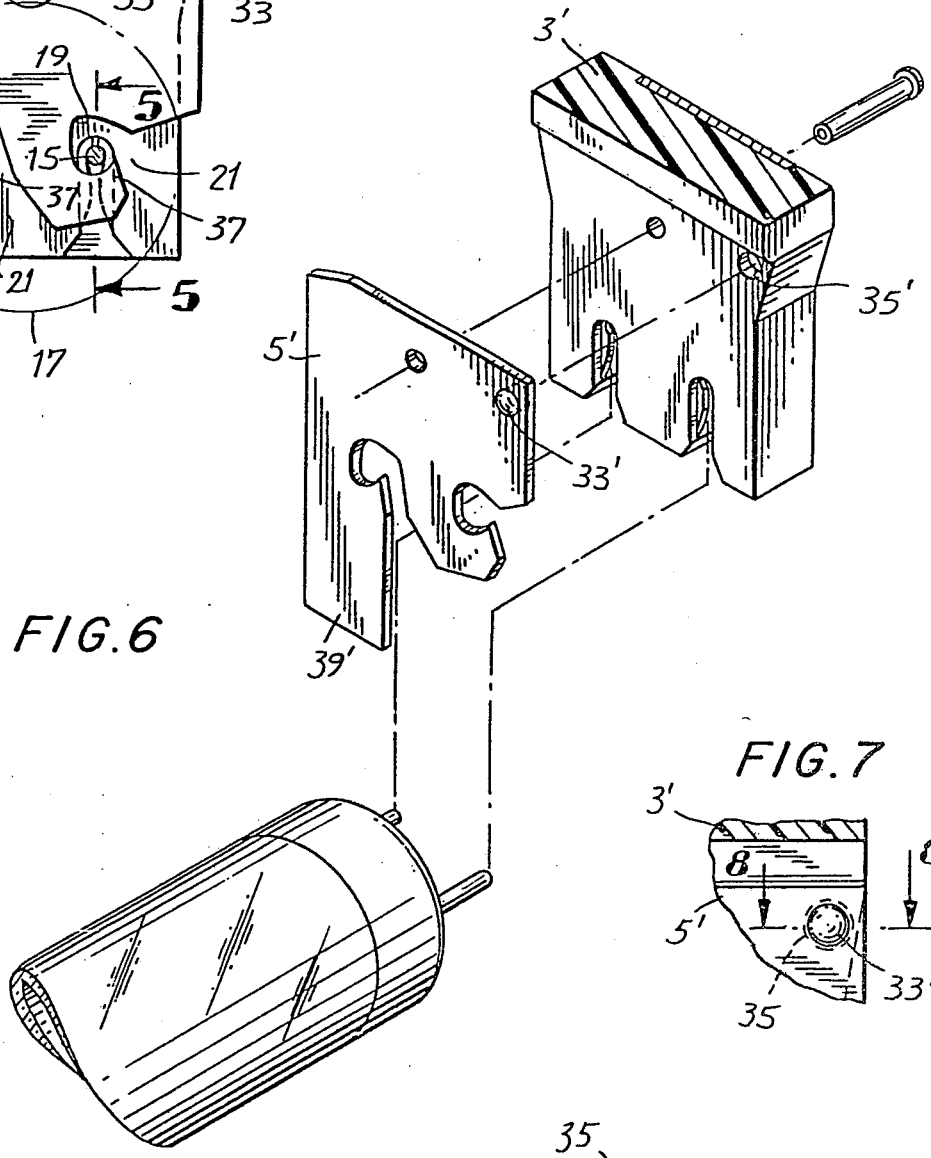
FIG. 6
FIG. 7
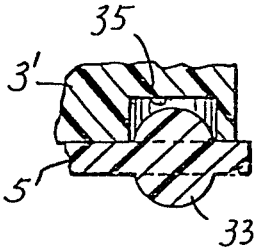
FIG. 8

FIG. 9
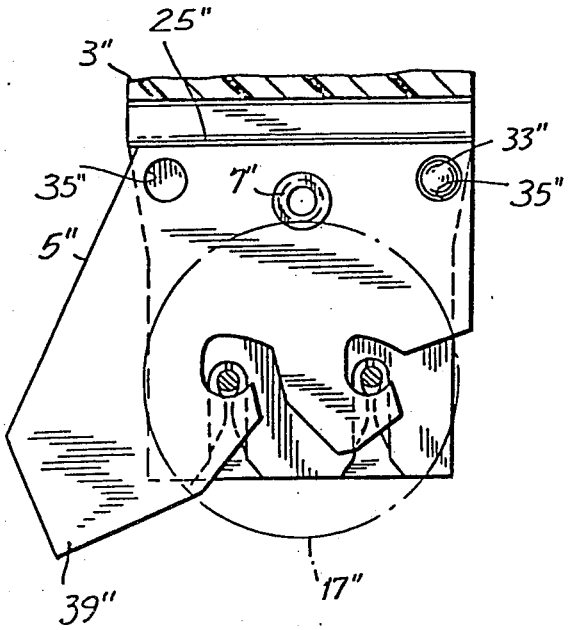
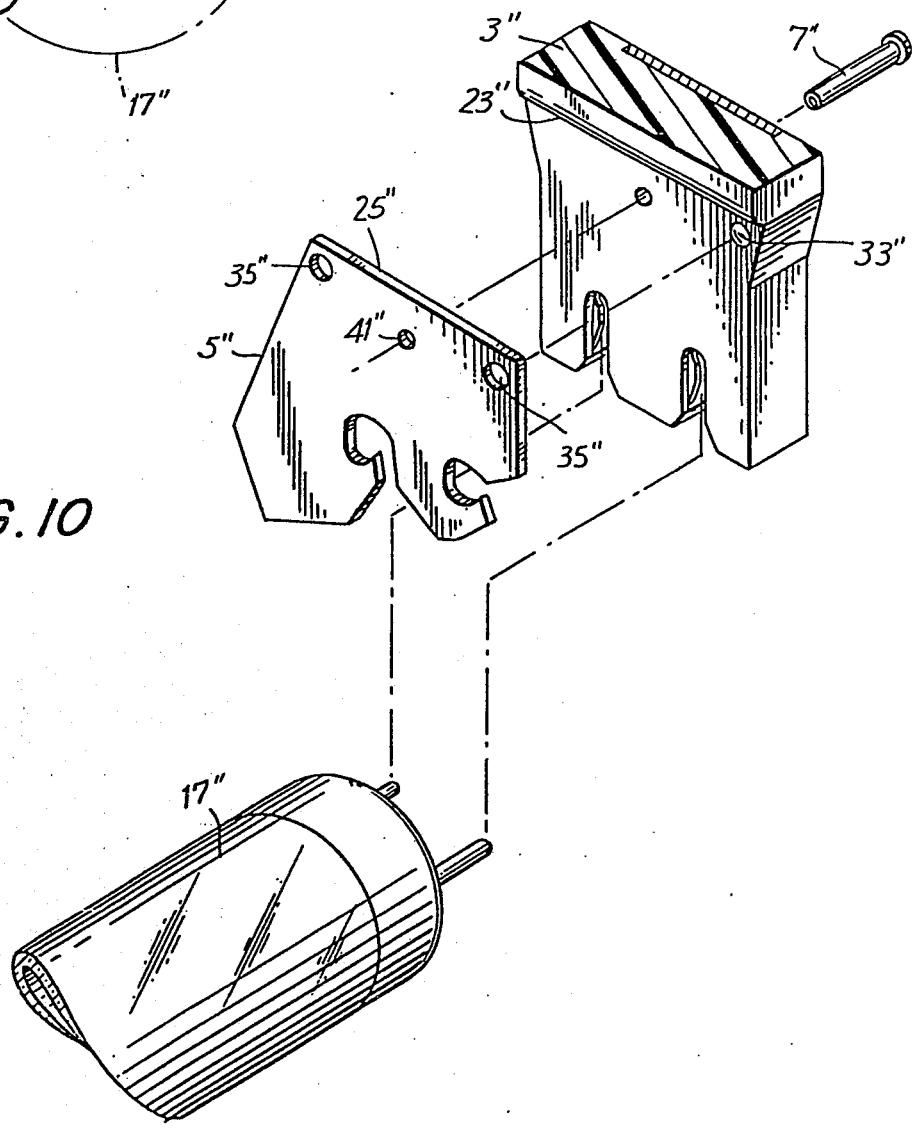
FIG. 10

FIG. 11
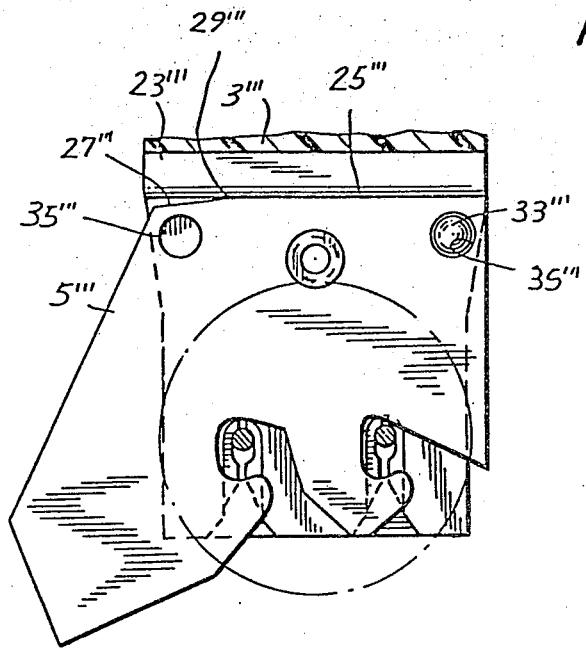
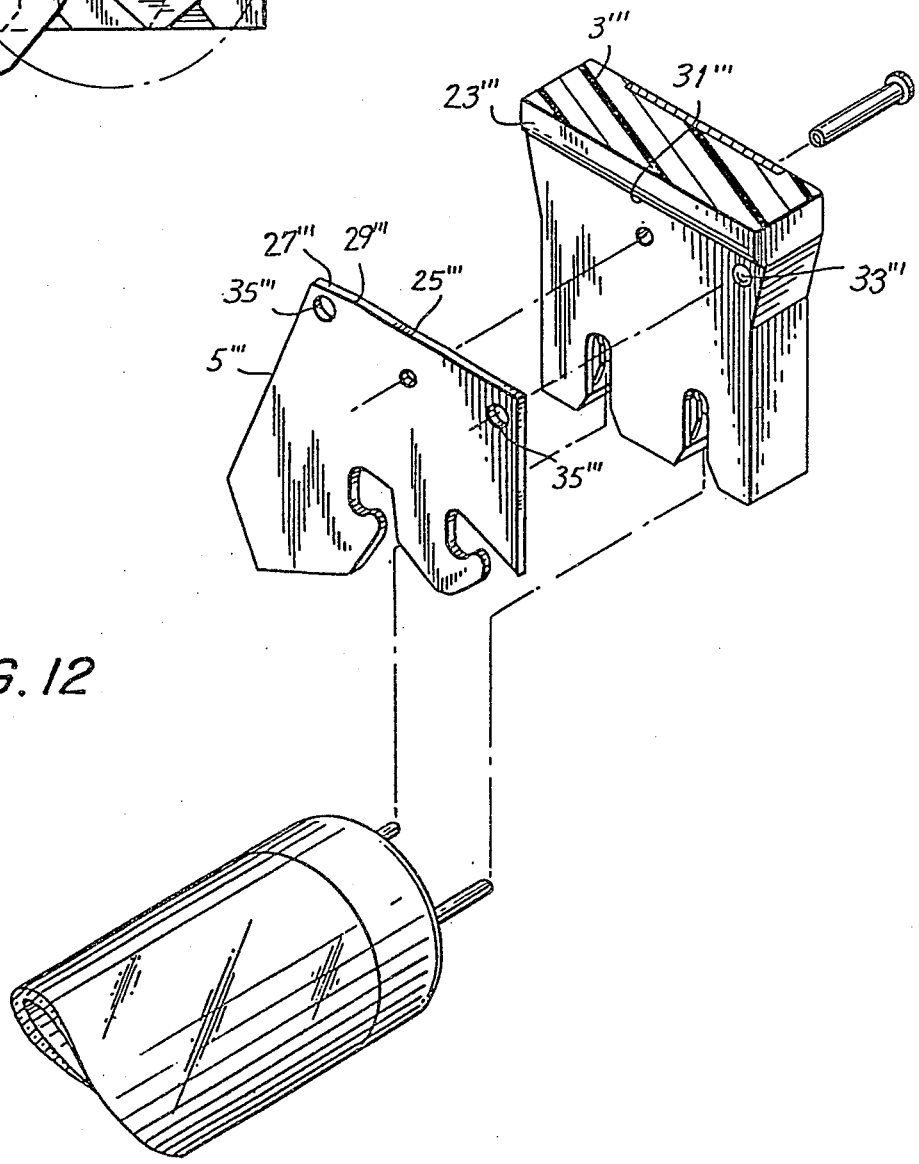
FIG. 12

LAMP HOLDER WITH SELF-LOCKING DEVICE

BACKGROUND OF THE INVENTION

Fluorescent lighting fixtures employing tubular lamps adapted to be held in resilient contacts at opposite ends of a fixture are often shipped from a fixture manufacturer to stores for resale to consumers with the lamps connected to the fixture. All that need be done to use the fixture is to hang it and connect a power cord to an AC supply line. The resilient contacts which grasp the pins of the lamp are normally strong enough to support the weight of the lamp. However, during shipping, the rough handling to which packaged fixtures are sometimes subjected is sufficient to impart forces to the lamps which cause them to come out of the contacts resulting in breakage and its attendant expense and inconvenience.

In some environments, fluorescent light fixtures in situ are subject to abnormal vibration as, for example, in areas susceptible to earthquakes and construction sites where blasting is being done or vibration transmitting machinery such as pile drivers is being used.

The foregoing problems have created a need for a fluorescent lamp holder wherein a lamp, once inserted, cannot inadvertently be shaken loose of the holder yet can be removed when it is desired as, for example, when replacing a burnt-out lamp, with facility. Fixtures are known in the prior art wherein a fluorescent tube is inserted into a circular channel, one pin at a time, and then rotated until it is locked in place. Such lamp holders are of questionable effectiveness in preventing a lamp from inadvertently coming out of the lamp holder and many people find it difficult to properly insert or remove a lamp from this type of lamp holder.

Lamp holders employing parallel channels with resilient grasping contacts disposed therein to permit the two pins at each end of the lamp to be forced into the channels and there grasped have been found much easier to use. The problem of lamps inadvertently coming out of this type of holder has been addressed by a device disclosed in U.S. Pat. No. 3,851,295 to Geier for Self-Locking Lamp Holder. Geier employs a relatively complex device using a spring and plunger mechanism internal to the lamp holder. This requires a special lamp holder construction which substantially increases the cost of the lamp holder. Neither Geier nor any of the known prior art devices provide an effective means for selectably locking and unlocking a lamp in place in a fluorescent light fixture without major and costly modification of the basic standard lamp holder design. The invention disclosed and claimed herein fulfills this need.

SUMMARY OF THE INVENTION

The present invention teaches the construction and use of a lamp holder including a locking device for preventing a lamp from inadvertently coming out of the lamp holder. The lamp holder has a housing in which there are formed spaced parallel channels leading to openings for admitting two parallel end pins of a standard fluorescent tube including resilient contacts for grasping the pins and a planar locking member tiltably mounted on the housing, the locking member having two respective channels with entrances which are at least partially in registration with the housing channels when the locking member is in an open position and which are moved out of registration with the openings in the housing channels when the locking member is rotated from the open position to a closed position. A projection on either the housing or the locking member and a complementary aperture or edge of the locking member serves to maintain the locking member in the closed position. A channel in the locking member has a cam edge against which one of the lamp pins is urged during normal insertion of the lamp into the lamp holder to cause the locking member to rotate from the open position to the closed position and be latched there in place thereby preventing the lamp from inadvertently coming out of the lamp holder.

It is, therefore, an object of the invention to provide a locking lamp holder which is similar in construction to a standard low-cost lamp holer but employing a readily preformed and inexpensive component to achieve the locking function.

Another object of the invention is to provide a locking lamp holder permitting visual determination of whether a lamp is locked in the holder from a distance.

Still another object of the invention is to provide a locking lamp holder having a locking device which can be mounted on the housing of a lamp holder in either of two opposite orientations for ease of access irrespective of the orientation of the lamp fixture.

A further object of the invention is to provide a locking lamp holder having a cam surface for causing rotation of the locking member during normal insertion of the lamp housing.

Other and further objects of the invention will be apparent from the following drawings and description of a preferred embodiment in which like reference numerals are used to indicate like parts in the various views.

DESCRIPTION OF THE DRAWINGS

FIG. 3 is a front elevation of the apparatus of the invention in a state after the lamp has been inserted and locked in place;

FIG. 6 is an exploded perspective view of an alternate embodiment of the invention with a fragmented view of a lamp with which the alternate embodiment is used;

FIG. 7 is a fragmented frontal elevation of a part of the embodiment of the invention shown in FIG. 6;

FIG. 8 is a sectioned plan view of a part of the apparatus of the invention shown in FIG. 7;

FIG. 9 is a frontal elevation of a second alternate embodiment of the apparatus of the invention;

FIG. 10 is an exploded perspective view of the second alternate embodiment of the apparatus of the invention shown in FIG. 9 with a fragmented perspective view of a lamp with which the second embodiment is used.

FIG. 11 is a frontal elevation of a third alternate embodiment of the apparatus of the invention; and FIG. 12 is an exploded perspective view of the third alternate embodiment of the apparatus of the invention with a fragmented perspective view of a lamp with which the third embodiment is used.

DESCRIPTION OF THE PREFERRED EMBODIMENTS

Figure 1:
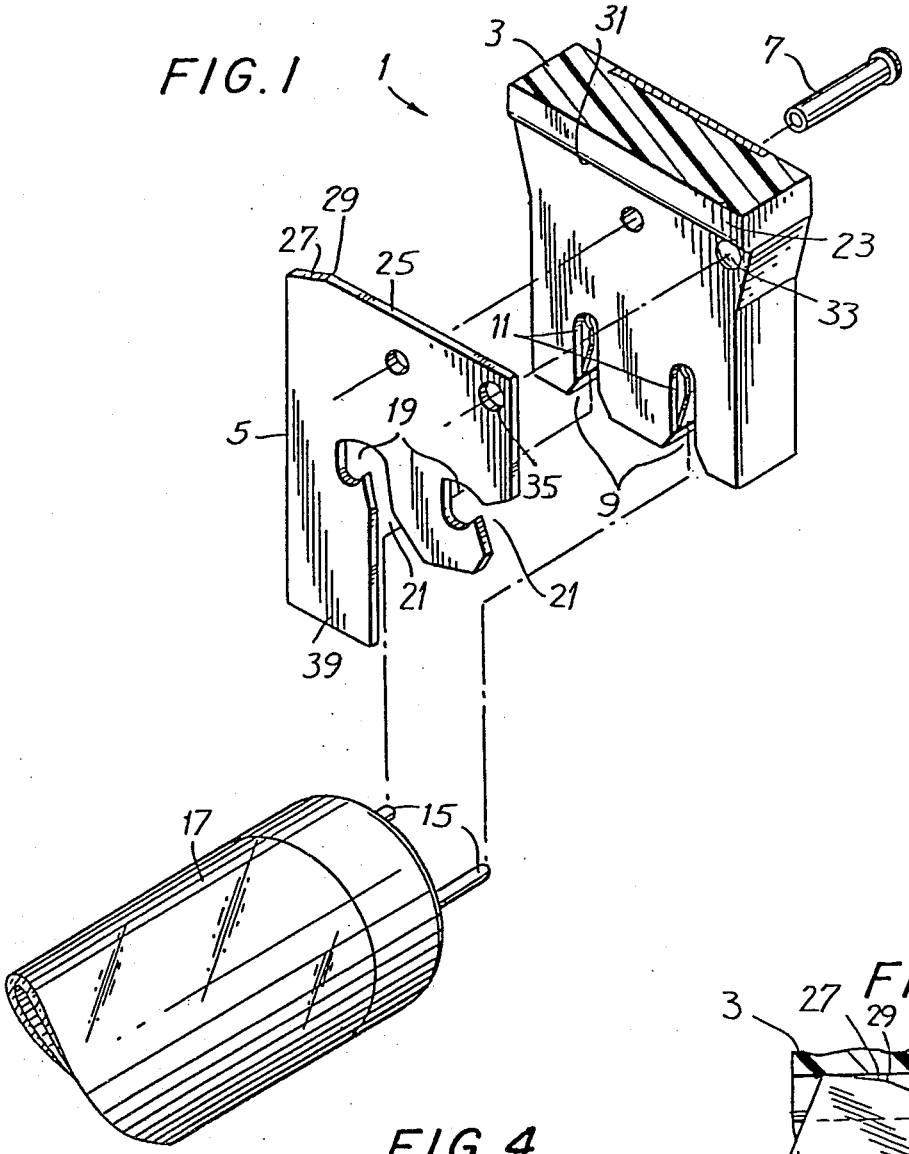
FIG. 1 is an exploded perspective view of the apparatus of the invention with a fragmented view of a lamp with which the apparatus is employed.

Referring now to FIG. 1, there is shown a locking lamp holder 1 having a housing 3 and a locking member 5 tiltably mounted on the housing for limited relative rotation by means of a cylindrical tubular rivet 7. The housing 3 has openings 9 in its bottom as shown in FIG. 1 leading into slotted channels 11 in which there are disposed resilient grasping contacts 13 (best shown in FIG. 2).

The contacts 13 are known to the art and are generally used to permit facile insertion of a pair of pins 15 on the end of a tubular fluorescent lamp 17 into a lamp holder to make electrical contact between the pins and an AC power line to which the contacts are connected and to hold the pins and, hence, the lamp in place.

Figure 2:
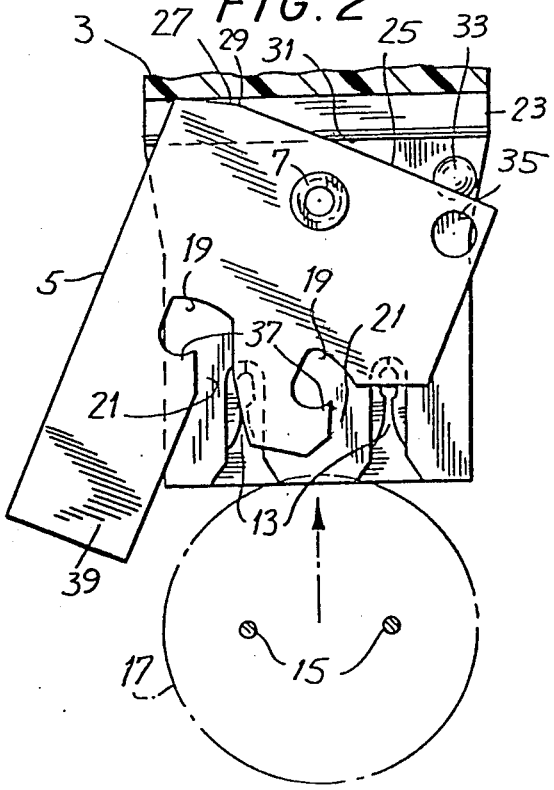
FIG. 2 is a front sectional elevation of the apparatus of the invention in a state suitable for admitting a lamp.

The locking member 5 is a relatively flat planar member mounted on the housing 3 for rotation in its plane between an open position as shown in FIG. 2 of the drawings and a closed position as shown in FIG. 3. The locking member 5 can be formed from a fiber based flexible material such as a cardboard.

The locking member 5 has channels or keyways 19 with entrances 21 which are in partial alignment with the contacts 13 when the locking member 5 is in an open position. Rotation of the locking member 5 passed the open position is prevented by a ledge 23 protruding from the top of the housing 3 into the plane of the locking member 5. The locking member 5 has a top edge 25 which is adjacent and parallel to the ledge 23 when the locking member 5 is in the closed position as shown in FIG. 3. Extending from the top edge 25 of the locking member 5 is an inclined edge 27 which meets the edge 25 at a corner 29 which aids in allowing the locking member 5 to be forced away from and over the ledge 23 in cooperation with an inward sloping cam surface 31 on the ledge 23.

Figure 4:
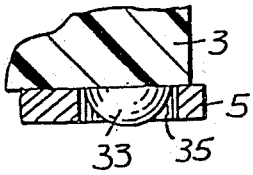
FIG. 4 is a sectional plan view of part of the apparatus of the invention taken through line 4—4 of FIG. 3.
Figure 5:
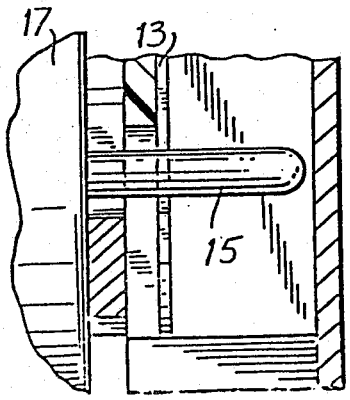
FIG. 5 is a sectional fragmented side elevation of the apparatus of the invention taken through line 5—5 of FIG. 3.

To aid in stopping the rotation of the locking member 5 from passing the closed position when tilted from the opened position to the closed position and for releasably holding the locking member 5 in the closed position are a spherical protuberance 33 on the front face of the housing 3 and a circular aperture 35 on the locking member. The aperture 35 is in alignment with the spherical protuberance 33 when the locking member 5 is in the closed position. The spherical protuberance 33 projects forwardly into the plane of the locking member 5 so that as the locking member 5 is tilted from an open position to a closed position, the locking member 5 is forced over the protuberance 33 until it registers with the aperture 35 at which time the resilient locking member 5 is restored to its plane with the protuberance 33 disposed in the aperture 35 there preventing inadvertent rotation of the locking member 5. The disposition of the spherical protuberance 33 in the aperture 35 of the locking member 5 is best seen in FIG. 4.

The channels 19 in the locking member 5 have hook-like curved portions 37 which are disposed beneath the pins 15 when the lamp 17 is inserted in the contacts 13 and the locking member 5 is tilted to a closed position. It is these curved hook-like surfaces 37 on the closed and locked locking member 5 which prevent inadvertent retraction of the pins 15 from the channels 9 of the lamp holder housing 3. A tab 39 extends from one side of the locking member 5 to serve as a lever for rotating the locking member 5.

Referring now to FIGS. 6, 7 and 8, there is shown an alternate embodiment of the locking lamp holder of the invention wherein a protuberance 33' is disposed on the planar surface of the locking member 5' facing the housing 3'. The locking member 5' has a gripping tab 39'. An aperture 35' is provided on the facing surface of the housing 3' and located so that the spherical protuberance 33' and the aperture 35' are in registration when the locking member 5' is in a closed position with respect to the housing 3' as previously described in connection with FIGS. 1 through 5. In other respects, the lamp holders of FIGS. 1 through 5 and 6 through 8 are similar.

Referring now to FIGS. 9 and 10, there is shown a second alternate embodiment of the apparatus of the invention. The second alternate embodiment employs a planar locking member 5'' pivotally mounted on a lamp holder housing 3'' by means similar to those illustrated in the embodiments of FIGS. 1 through 8. The locking member 5'' employs a tab 39'' which extends downwardly and laterally in contradistinction to the tabs 39 and 39' of the first and first alternate embodiments of FIGS. 1–5 and 6–8, respectively. The tab 39'' extends further beyond the surface of the lamp 17'' for facilitated application of finger pressure for rotating the locking member 5'' from a closed position to an opened position for removing the lamp 17'' as, for example, when the lamp 17'' is burnt out and in need of replacement.

The locking member 5'' has dual apertures 35'' symmetrically disposed with respect to the pivot point 41'' defined by an aperture in which rivet 7'' is disposed. With this arrangement, the housing 3'' and locking member 5'' can be assembled with either planar surface facing the housing 3'' so that one of the apertures 35'' is in registration with a spherical protuberance 33'' on the facing housing wall when the locking member 5'' is in its closed position irrespective of which of two possible orientations of the locking member 5'' is used. Thus, for asymmetrical fixtures which must be mounted in a predefined orientation, the locking member can always have a preferred orientation for releasing the lamp when desired.

The locking member of the lamp holder shown in FIGS. 9 and 10 has a top edge 25'' adapted to engage the ledge 23'' when the locking member 25'' is in the closed position.

Referring now to FIGS. 11 and 12, as previously described in connection with the embodiments of FIGS. 1 through 8, a locking member 5''' can have an inclined edge 27''' meeting the top edge 25''' to form a corner 29''' which cooperates with an inward sloping cam surface 31''' on the ledge 23''' of the housing 3'''.

It will be appreciated that the teachings of the invention can be applied to other than the foregoing described preferred embodiments without deviating from the spirit and scope of the invention which is to be limited only by the following claims.

What is claimed is:

1. A lamp holder for holding one end of a lamp having dual parallel connecting pins in a light fixture comprising:

a housing having a top and a bottom, said bottom having first and second spaced openings leading to respective first and second channels adapted to receive said pins;

first and second resilient contact means disposed in said first and second channels respectively for engaging and making electrical contact with said pins when inserted in said channels;

a planar locking member tiltably mounted on said housing for limited rotation between an open position and a closed position about an axis normal to the plane of said planar member; and stop means on said housing for limiting rotation of said locking member between said open position and said closed position, said locking member having first and second channels including respective first and second entrances thereto, said first and second entrances at least partially aligning with said first and second openings in said housing when said locking member is in said open position to admit said pins into said first and second locking member channels and said first and second housing channels, said locking member overlapping said housing channels to prevent withdrawal of said pins therefrom when in said closed position.

2. Apparatus according to claim 1 wherein said locking member channels have a cam edge adapted to be engaged by one of said pins when in said open position as said lamp is installed in said lamp holder for rotating said locking member to said closed position.

3. Apparatus according to claim 2 further comprising first cooperating means on said housing and on said locking member for releasably holding said locking member in said closed position.

4. Apparatus according to claim 3 wherein said first cooperating means on said housing comprises one of an aperture and a protuberance adapted to be received in said aperture and said cooperating means on said locking member comprises the other of said aperture and said protuberance.

5. Apparatus according to claim 3 wherein said locking member is formed from a fiber based flexible material.

6. Apparatus according to claim 3 wherein said locking member has a portion extending beyond said housing adapted to have applied to it a pressure for rotating said locking member from said closed position to said open position to permit withdrawal of said lamp from said lamp holder.

7. Apparatus according to claim 3 wherein a portion of at least one of said first and second locking member channels has a curved hook-like shape defining an edge for preventing withdrawal of a corresponding lamp pin from said housing.

8. Apparatus according to claim 3 further comprising second cooperating means on said housing and on said locking member, said first and second cooperating means on said locking member being substantially identical on opposite planar sides of said locking member.

9. Apparatus according to claim 8 wherein said first and second cooperating means on said locking member are symmetrically disposed about the pivot at which said locking member is mounted on said housing.

10. Apparatus according to claim 1 wherein said stop means on said housing comprises a ledge protruding into the plane in which said locking member is rotatably disposed.

11. Apparatus according to claim 10 wherein an edge of said locking member has an inclined portion comprising a cam surface for urging said edge over said ledge when said locking member is rotated into said open position.

* * * * *